US009149125B2

(12) United States Patent
Davis et al.

(10) Patent No.: US 9,149,125 B2
(45) Date of Patent: Oct. 6, 2015

(54) ADJUSTABLE SUPPORT APPARATUS

(75) Inventors: Edmund Scott Davis, Clover, SC (US); Keith Richard Coponi, Davie, FL (US)

(73) Assignee: BANYAN LICENSING L.L.C., Charlotte, NC (US)

( * ) Notice: Subject to any disclaimer, the term of this patent is extended or adjusted under 35 U.S.C. 154(b) by 8 days.

(21) Appl. No.: 13/699,956

(22) PCT Filed: May 24, 2011

(86) PCT No.: PCT/US2011/037766

§ 371 (c)(1),
(2), (4) Date: Jul. 8, 2013

(87) PCT Pub. No.: WO2011/149957

PCT Pub. Date: Dec. 1, 2011

(65) Prior Publication Data

US 2013/0278029 A1 Oct. 24, 2013

Related U.S. Application Data

(60) Provisional application No. 61/347,739, filed on May 24, 2010.

(51) Int. Cl.
*A47C 4/54* (2006.01)
*A47C 7/42* (2006.01)
(Continued)

(52) U.S. Cl.
CPC . *A47C 7/46* (2013.01); *A47C 7/467* (2013.01); *A61H 1/0292* (2013.01);
(Continued)

(58) Field of Classification Search
USPC ..... 297/284.5, 284.6, 452.26, 452.27, 297/452.32, 452.37, 452.48, 284.4
See application file for complete search history.

(56) References Cited

U.S. PATENT DOCUMENTS 3,222,697 A * 12/1965 Scheermesser ..... 297/452.48 X
3,258,791 A * 7/1966 Kaplan ..... 5/736
(Continued)

FOREIGN PATENT DOCUMENTS

JP 2003-062026 A 3/2003
KR 20-0155082 Y1 8/1999
KR 10-2003-0057310 A 7/2003

OTHER PUBLICATIONS

International Preliminary Report on Patentability issued Nov. 27, 2012 for International Patent Application No. PCT/US2011/037766.

*Primary Examiner* — Rodney B White
(74) *Attorney, Agent, or Firm* — Moore & Van Allen PLLC

(57) ABSTRACT

An adjustable support apparatus for a user includes a cover defining a user-facing surface, at least a portion of the user-facing surface defining a plurality of raised members each defining a distal end, wherein the distal end of each raised member defines a planar surface. The apparatus includes an adjustment mechanism at least partially enclosed by the cover. The adjustment mechanism is structured to be urged toward or away from the user so as to urge the user-facing surface and plurality of raised members toward or away from the user, respectively, so as to increase or decrease, respectively, the spacing between the distal ends of the raised members to thereby increase or decrease, respectively, the force exerted by the raised members against the user so as to impart a stretching or lengthening effect or contraction effect, respectively, on the vertebral column and intervertebral discs of the user.

20 Claims, 5 Drawing Sheets

(51) Int. Cl.
*A47C 7/46* (2006.01)
*A61H 1/02* (2006.01)
*A61H 9/00* (2006.01)

(52) U.S. Cl.
CPC ..... *A61H 9/0078* (2013.01); *A61H 2201/0138* (2013.01); *A61H 2201/1246* (2013.01); *A61H 2203/0425* (2013.01)

(56) References Cited

U.S. PATENT DOCUMENTS 3,974,827 A * 8/1976 Bodeen ..... 297/284.6 X
4,064,578 A * 12/1977 Yamada ..... 297/452.27
4,276,666 A * 7/1981 Yamada ..... 5/736
4,320,543 A * 3/1982 Dixon ..... 5/637
4,383,342 A 5/1983 Forster
4,449,751 A * 5/1984 Murphy et al. ..... 297/284.4
4,516,568 A * 5/1985 Baxter et al. ..... 297/284.5 X
4,518,200 A * 5/1985 Armstrong ..... 297/284.6
4,534,592 A * 8/1985 Hattori ..... 297/284.4
4,718,724 A * 1/1988 Quinton et al. ..... 297/284.5
4,759,543 A * 7/1988 Feldman ..... 297/284.6 X
4,989,284 A * 2/1991 Gamm ..... 5/653
5,030,501 A * 7/1991 Colvin et al. ..... 428/178
5,190,347 A * 3/1993 Shiow-Lan ..... 297/284.5
5,294,181 A * 3/1994 Rose et al. ..... 297/452.27 X
5,314,235 A * 5/1994 Johnson ..... 297/284.5
5,385,531 A * 1/1995 Jover ..... 297/284.4 X
5,836,900 A * 11/1998 Leventhal ..... 297/284.5 X
6,220,663 B1 * 4/2001 Benden et al. ..... 297/284.6
6,256,818 B1 * 7/2001 Hughes ..... 5/639
6,290,295 B1 * 9/2001 Benden et al. ..... 297/284.6
6,546,578 B1 * 4/2003 Steinmeier ..... 297/452.48 X
6,596,387 B2 * 7/2003 Ogle ..... 428/304.4
6,598,251 B2 * 7/2003 Habboub et al. ..... 297/452.48 X
6,938,290 B2 * 9/2005 McKinney et al. .. 297/452.27 X
7,055,199 B2 * 6/2006 Thompson ..... 5/655.3
7,424,761 B1 * 9/2008 Graebe ..... 5/653
7,437,789 B2 * 10/2008 Thompson ..... 5/655.3
7,513,002 B2 * 4/2009 Best ..... 5/655.3
7,681,264 B2 * 3/2010 Graebe ..... 5/653
7,946,654 B2 * 5/2011 Tsuber et al. ..... 297/452.21
8,087,726 B2 * 1/2012 Chen ..... 297/284.5
2003/0111885 A1 * 6/2003 McMillen ..... 297/284.4
2003/0117002 A1 * 6/2003 McMillen ..... 297/284.4
2008/0201853 A1 * 8/2008 Graebe ..... 5/653
2010/0314929 A1 * 12/2010 Hsu ..... 297/452.48

* cited by examiner

ADJUSTABLE SUPPORT APPARATUS

FIELD OF THE INVENTION

The present invention relates generally to an adjustable support apparatus.

BACKGROUND OF THE INVENTION

Problems due to deformed or displaced intervertebral disks or other discopathy are a frequent reason for back pain. This is often a problem encountered by the elderly due to the intervertebral disk tissue having lost its elasticity. Typically, the load on the dorsal spine is not even relieved during lying since most persons suffering from discopathy do not use a suitable mattress.

It is well known that the intervertebral disks are able to reabsorb fluid upon relieving load, i.e., by lengthening the dorsal spine. Due to this reason, devices for stretching or lengthening the dorsal spine have been proposed such as disclosed in U.S. Pat. No. 4,383,342 to Foster and U.S. Pat. No. 6,704,961 to Kielein. Conventional solutions have included pillows or cushions with ribs configured to cause stretching or lengthening of the dorsal spine. However, such conventional apparatus are dependent entirely on the amount of pressure the user is able to exert against the apparatus in order to cause stretching, which can be difficult or painful for the elderly, especially if the user is experiencing severe back pain.

BRIEF SUMMARY OF THE DISCLOSURE

Presented herein are an adjustable support apparatus and method of using the same. According to one embodiment, the adjustable support apparatus comprises a cover defining a user-facing surface, at least a portion of the user-facing surface defines a plurality of raised members. The apparatus includes an adjustment mechanism that enables a user to selectively and incrementally increase the pressure exerted by the user-facing surface of the support apparatus and, specifically, the raised members, on the back of the user to increase the normal and surface forces exerted by the raised members on the user's back and, thus, spine, to thereby provide an enhanced stretching or lengthening effect on the spine.

According to one embodiment, the method of the present invention includes providing an adjustable support apparatus comprising a cover defining a user-facing surface, at least a portion of the user-facing surface comprising a plurality of raised members. The apparatus further includes an adjustment mechanism that enables a user to selectively and incrementally increase the pressure exerted by the user-facing surface of the support apparatus and, specifically, the raised members, on the back of the user to increase the normal and surface forces exerted by the raised members on the user's back and, thus, spine, to thereby provide an enhanced stretching or lengthening effect on the spine.

In one embodiment, the adjustment mechanism comprises a bladder at least partially enclosed by the cover. The bladder is structured to be inflated or deflated so as to urge the user-facing surface and plurality of raised members toward or away from the user, respectively, so as to increase or decrease, respectively, the normal and surface forces exerted by the raised members on the user's dorsal spine. Similarly, according to one embodiment, the method of the present invention includes providing an adjustable support apparatus comprising a cover defining a user-facing surface, at least a portion of the user-facing surface comprising a plurality of raised members. The apparatus further includes providing an adjustment mechanism comprising a bladder at least partially enclosed by the cover. In one embodiment, the bladder is inflated so as urge the user-facing surface and plurality of raised members toward the user so as to increase the normal and surface forces exerted by the raised members on the user's dorsal spine. In another embodiment, the bladder is deflated so as urge the user-facing surface and plurality of raised members away from the user so as to decrease the normal and surface forces exerted by the raised members on the user's dorsal spine.

In one embodiment, the adjustment mechanism comprises a cam or cam-follower assembly at least partially enclosed by the cover. The cam or cam-follower assembly is structured to be rotated so as to urge the user-facing surface and plurality of raised members toward or away from the user, respectively, so as to increase or decrease, respectively, the normal and surface forces exerted by the raised members on the user's dorsal spine. Similarly, according to one embodiment, the method of the present invention includes providing an adjustable support apparatus comprising a cover defining a user-facing surface, at least a portion of the user-facing surface comprising a plurality of raised members. The apparatus further includes providing an adjustment mechanism comprising a cam or cam-follower assembly at least partially enclosed by the cover. In one embodiment, the cam or cam-follower assembly is rotated in a first direction so as urge the user-facing surface and plurality of raised members toward the user so as to increase the normal and surface forces exerted by the raised members on the user's dorsal spine. In another embodiment, the cam or cam-follower assembly is rotated in a second direction that is opposite to the first direction so as urge the user-facing surface and plurality of raised members away from the user so as to decrease the normal and surface forces exerted by the raised members on the user's dorsal spine.

In one embodiment, the adjustment mechanism comprises a piston assembly at least partially enclosed by the cover. The piston assembly can be pneumatic or hydraulic. The piston assembly is structured to be extended or retrieved so as to urge the user-facing surface and plurality of raised members toward or away from the user, respectively, so as to increase or decrease, respectively, the normal and surface forces exerted by the raised members on the user's dorsal spine. Similarly, according to one embodiment, the method of the present invention includes providing an adjustable support apparatus comprising a cover defining a user-facing surface, at least a portion of the user-facing surface comprising a plurality of raised members. The apparatus further includes providing an adjustment mechanism comprising a piston assembly at least partially enclosed by the cover. In one embodiment, the piston of the piston assembly is extended in a first direction so as urge the user-facing surface and plurality of raised members toward the user so as to increase the normal and surface forces exerted by the raised members on the user's dorsal spine. In another embodiment, the piston of the piston assembly is retrieved so as urge the user-facing surface and plurality of raised members away from the user so as to decrease the normal and surface forces exerted by the raised members on the user's dorsal spine.

BRIEF DESCRIPTION OF THE SEVERAL VIEWS OF THE DRAWING(S)

Reference will now be made to the accompanying drawings, which are not necessarily drawn to scale, and wherein.

Figure 7:
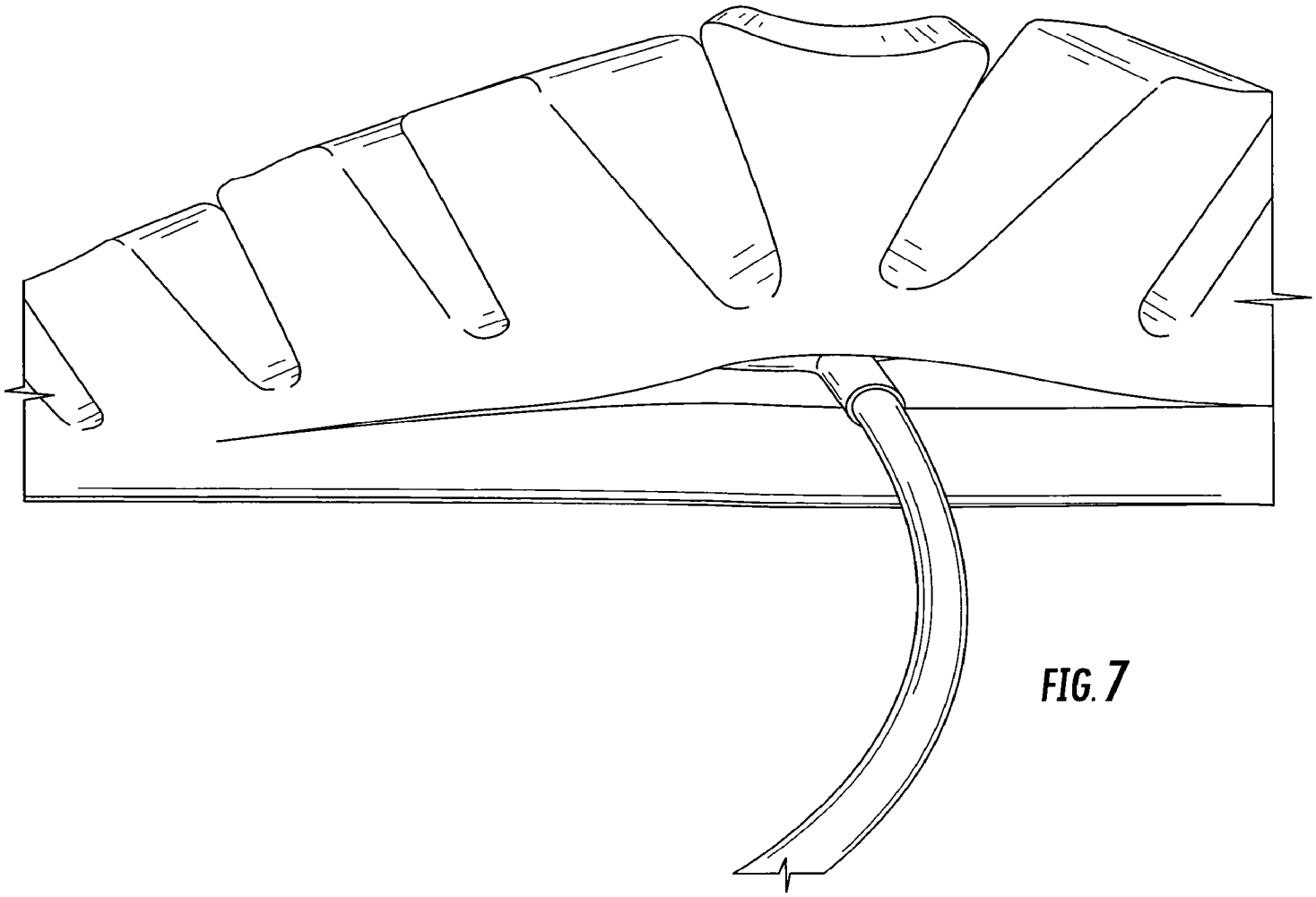
Figure 8:
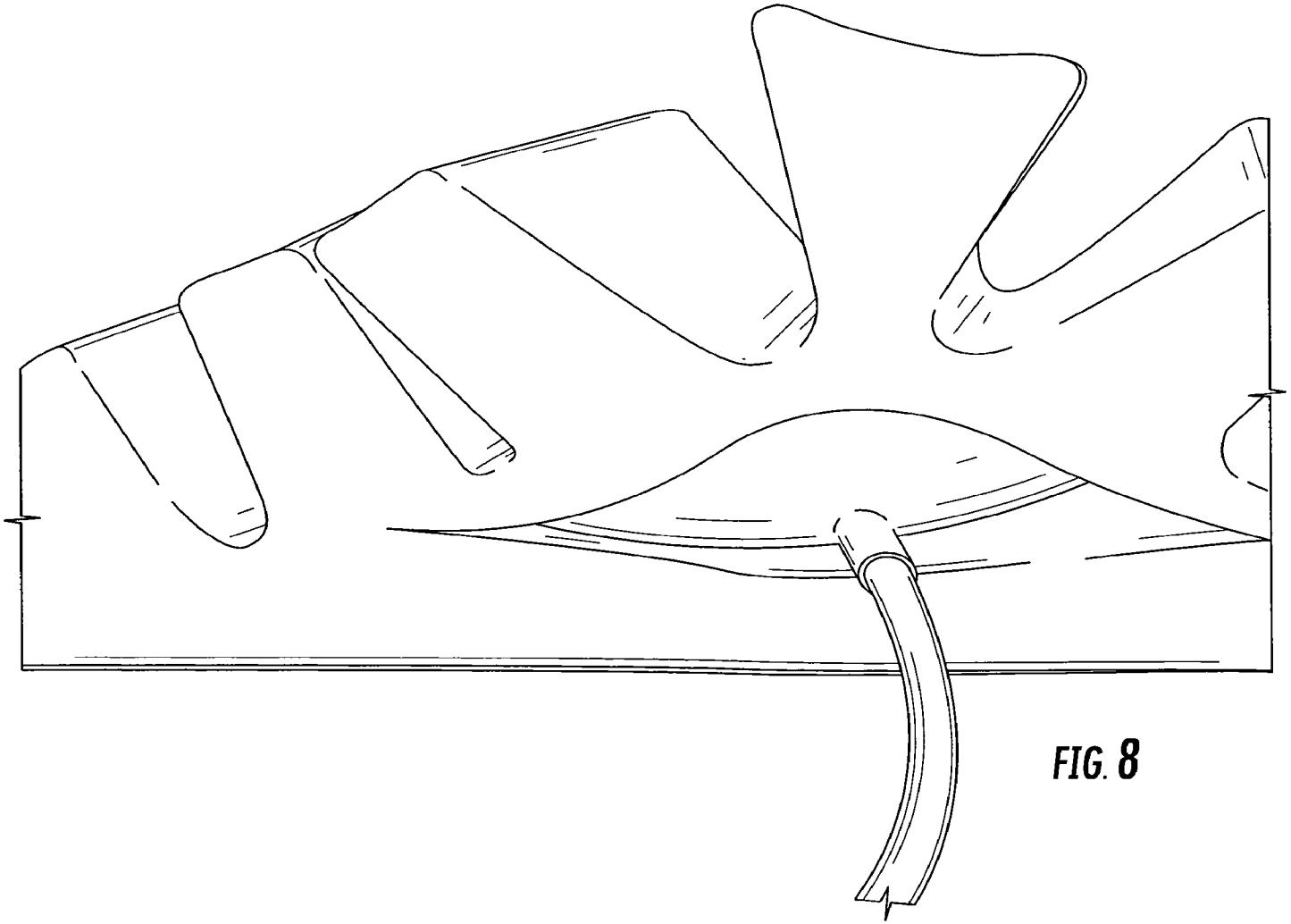

FIG. 7 is a color photograph illustrating the adjustable support apparatus having an adjustment mechanism comprising an inflatable bladder, in which the bladder is in the non-inflated position, according to one embodiment of the present invention; and FIG. 8 is a color photograph illustrating the adjustable support apparatus having an adjustment mechanism comprising an inflatable bladder, in which the bladder is in the inflated position, according to one embodiment of the present invention

DETAILED DESCRIPTION OF THE DRAWINGS

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form, and vice versa. Also, as used herein, the term "a" shall mean "one or more," even though the phrase "one or more" is also used herein. Like numbers refer to like elements throughout.

Figure 1:
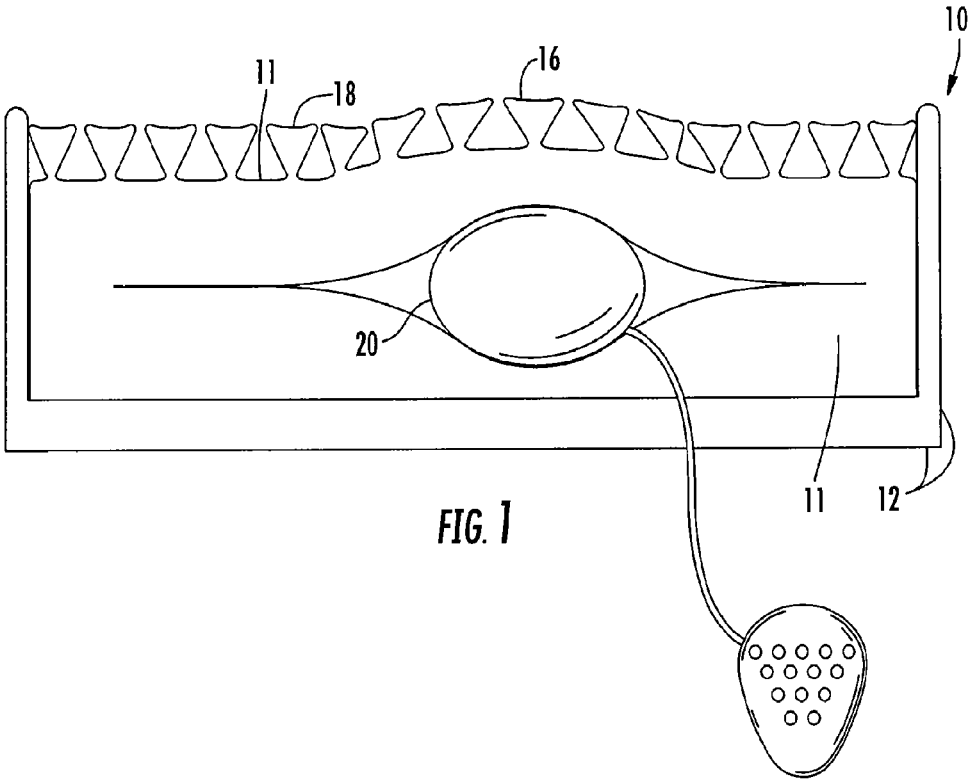
FIG. 1 is a cross-sectional view illustrating a support apparatus, according to one embodiment of the invention.

Referring to the figures and, more particularly to FIG. 1, there is illustrated an adjustable support apparatus 10, according to one embodiment of the present invention. The support apparatus 10 may comprise a pillow, mattress, mattress topper, cushion, seat, sofa, chair or other item of furniture for sitting or lying. The support apparatus 10 may include structural supports or frame members 12 (e.g., in the case of furniture) that can be formed of plastic, wood, metal or another relatively rigid material. For pillows or cushions or the like, support members 12 may not be necessary or desired. The exterior or cover 11 of the support apparatus 10 may be formed of plastic, rubber, cloth, leather or other covering material, including combinations of the foregoing, and may further include a filling material 14, such as feathers, fiber or cloth padding, metal or plastic springs, air, water, etc. The configuration of the support apparatus 10 will vary depending on the particular use. In a preferred embodiment, the cover 11 of the support apparatus 10 has a user-facing surface 16 that is relatively soft, as this surface will be in contact with the user. In one embodiment, the user-facing surface 16 is formed of an elastomeric material, such as a rubber or flexible plastic, or polyurethane foam. If polyurethane foam is used, the foam may have an indentation force deflection (IFD) of 40 IFD to 170 IFD and, more preferably, of 75 IFD to 150 IFD. As used herein, the IFD is the amount of force, in pounds, required to indent a fifty (50) square inch, round indentor foot into a predefined foam specimen twenty-five percent (25%) of the specimen's total thickness. Test methods for determining the IFD are specified by the American Society for Testing and Material, and may include, without limitation, the test methods described in ASTM D 1564-63T or D3574.

Figure 2:
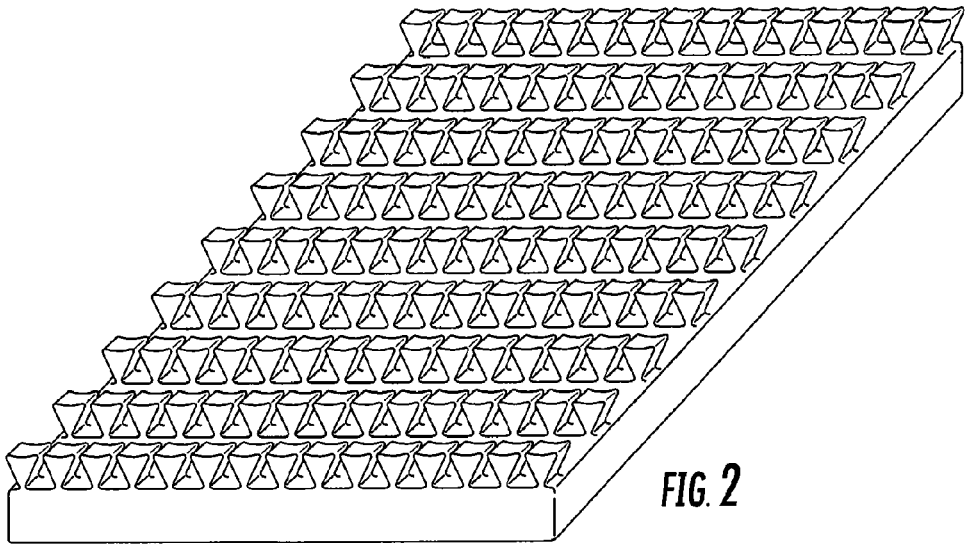
FIG. 2 is a perspective view illustrating the raised members on the user-facing surface of the support apparatus, according to one embodiment of the invention.

At least some portion of the user-facing surface 16 preferably defines a plurality of ribs, projections, protuberances, or other surface areas that are raised (collectively referred to herein as "raised members 18"). The raised members 18 preferably have some flexibility (in other words, are not rigid) as the raised members will be in contact with the user. In one embodiment, the raised members 18 are formed of an elastomeric material, such as a rubber or flexible plastic, or polyurethane foam. The polyurethane foam of the raised members 18 may have a similar IFD as the polyurethane foam of the user-facing surface 16. The raised members 18 may be positioned in a pattern about the user-facing surface 16 or may be positioned irregularly about the user-facing surface in no particular pattern or symmetry. For example, in one embodiment, as illustrated in FIG. 2, the raised members 18 are equally spaced from one another in equally-spaced rows. The raised members 18 may protrude out straight or be angled, tilted or otherwise biased in a particular direction. Each raised member 18 can have a uniform cross-section or one that varies in size and/or configuration. Examples of raised portions and their configurations are detailed in U.S. Pat. No. 4,383,342 to Forster, which issued on May 17, 1983, and U.S. Pat. No. 6,704,961 to Kienlein, which issued on Mar. 16, 2004, both of which are hereby incorporated by reference.

The support apparatus 10 includes an adjustment mechanism 20 that is at least partially encased or enclosed by the cover 11. The user-facing surface 16 and raised members 18 are positioned between (i.e., sandwiched between) the adjustment mechanism 20 and the back of the user. The adjustment mechanism 20 enables a user to selectively and incrementally urge the user-facing surface 16 of the support apparatus and the raised members 18 towards or away from the back of the user (which should remain relatively stationary) so as to increase or decrease, respectively, the resulting normal and surface forces exerted by the raised members on the user's back and, thus, spine, to thereby provide an enhanced stretching or lengthening effect on the spine. The enhanced stretching or lengthening effect on the spine is a result of the reactionary forces created by the user remaining relatively stationary, which reactionary forces act through the user's back and dorsal spine, in opposition to the pressure exerted by the user-facing surface and raised members. The adjustment mechanism 20 can comprise a variety of mechanical apparatus that are structured or configured to exert force in a predetermined direction, including, without limitation, an inflatable bladder 40, a cam or cam-follower assembly 60, or a piston assembly 80. In other embodiments, the support apparatus 10 can comprises a plurality of adjustment mechanisms of the same or different types, e.g., multiple bladders, cam or cam-follower assemblies or piston assemblies or, alternatively, combinations of bladders, cam-follower assemblies and/or piston assemblies.

Additionally, according to one embodiment of the present invention, the user-facing surface 16 and raised members 18 are both formed of a rubber, soft plastic, polyurethane foam or other relatively flexible and soft material or materials that are relatively elastic such that the material or materials may stretch substantially without tearing. Advantageously, when the adjustment mechanism 20 is enabled by the user so that it begins to urge the user-facing surface 16 of the support apparatus and the raised members 18 towards the back of the user, the portions of the user-facing surface 16 between the raised members 18 begins to expand, which increases the spacing between the raised members. As the spacing increases the raised members 18 located in the area of stretching begin to move away from one another thereby further increasing the resulting normal and surface forces exerted by the raised members on the user's back and spine to provide an even more enhanced stretching or lengthening effect against the vertebral column and hence the intervertebral disks of the user so as to provide an improved tensile relieving effect on the intervertebral disks of the user thereby allowing the disks to reabsorb fluid. Alternatively, as illustrated in the photographs of FIGS. 7 and 8, the support apparatus 10 can be structured so that as the adjustment mechanism 20 is enabled by the user so that it begins to urge the user-facing surface 16 and the raised members 18 towards the back of the user, the portions of the user-facing surface 16 between the raised members 18 may not expand or may do so negligibly, but the raised members 18 are configured to pivot about the user-facing surface so that the spacing between of at least some of the raised members increases thereby providing the more enhanced stretching or lengthening effect against the vertebral column.

The support apparatus 10 may include a controller 24 in electrical communication with the adjustment mechanism 20. The controller 24 may include an on/off switch that activates the adjustment mechanism 20 so as to increase or decrease the amount of force or pressure exerted by the adjustment mechanism through the user-facing surface 16 and raised members 18 on the user's back and spine. The controller can be configured to allow the user to hold the pressure exerted by the adjustment mechanism through the user-facing surface 16 and raised members 18 on the user's back and spine constant or to intermittently increase and decrease the exerted pressure to create a massaging effect.

Figure 4:
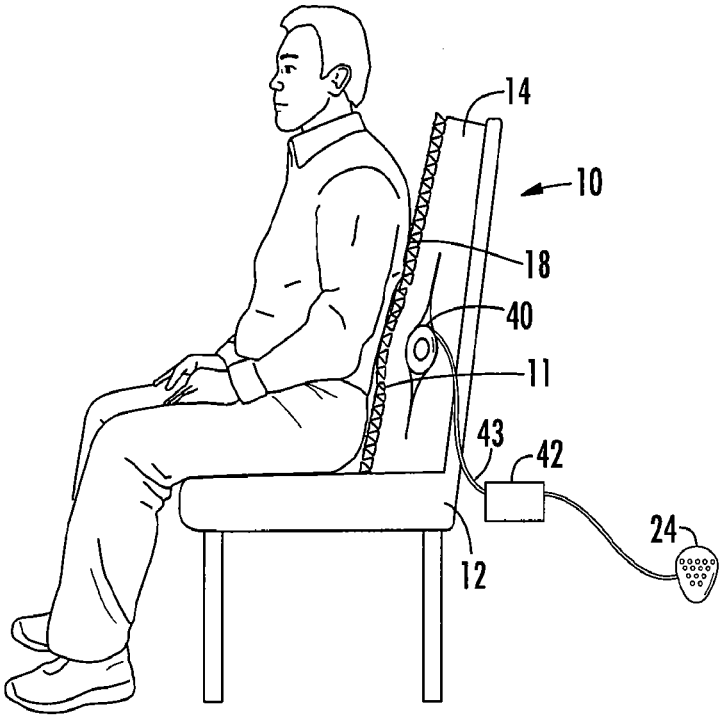
FIG. 4 is a cross-sectional view illustrating the adjustable support apparatus having an inflatable bladder as the adjustment mechanism, according to one embodiment of the present invention.

In one embodiment, as illustrated in FIG. 4, the adjustment mechanism 20 comprises an inflatable pneumatic or hydraulic bladder 40. The bladder 40 may be in fluid or gaseous communication with a pump 42, such as through a flexible hose 43. The bladder 40 can be formed of a variety of flexible and elastic materials, including plastic or rubber, that are capable of stretching elastically as the gas or fluid is pumped into and out of the bladder. The bladder 40 includes an exterior layer of material with a hollow interior. In one embodiment, the bladder 40 has a tubular configuration. In another embodiment, the bladder 40 has a circular configuration. In other embodiments, the support apparatus 10 includes a plurality of bladders 40 either positioned adjacent one another or spaced apart.

A controller 24 may be provided that is in operable communication with the pump 42 so that the user may initiate the pumping of gas or fluid into the bladder to inflate or increase the size of the bladder or, alternatively, to either allow gas or fluid to leak out of the bladder or pump gas or fluid out of the bladder to deflate or decrease the size of the bladder. The bladder 40 may include a reservoir (not shown) in gaseous or fluid communication with the pump 42 for retaining the gas or fluid used to inflate the bladder.

In one embodiment, the support apparatus 10 may be configured to maintain a specific pressure level in the bladder 40. For example, the bladder 40 or hose connecting the pump 42 to the bladder may include a pressure gage (not shown). The pressure gage may be in electrical communication with the controller 24, which can include a processor operating under software, firmware or other computer programming instructions. The controller 24 monitors the pressure gage and turns on the pump 42 as necessary to maintain a constant pressure. For example, in one embodiment, the controller 24 at predetermined intervals queries the pressure gage for the pressure of the gas or fluid in the bladder 40. The pressure gage communicates data to the controller 24 representing the pressure of the gas or fluid in the bladder 40, the controller compares this data to the desired pressure. If the pressures are the same, then the controller 24 takes no further action until the time for the next pressure reading. If the pressure of the gas or fluid in the bladder 40 is less than the desired pressure, then the controller 24 instructs the pump to initiate the pumping of gas or fluid into the bladder to inflate or increase the size of the bladder. If the pressure of the gas or fluid in the bladder 40 is more than the desired pressure, then the controller 24 instructs the pump to either allow gas or fluid to leak out of the bladder or to pump gas or fluid out of the bladder to deflate or decrease the size of the bladder.

In another embodiment, the bladder 40 may be manually operated such that the user can blow gas or fluid into the bladder. For a manually operated bladder 40, the bladder preferably is capable of being sealed to prevent leakage of the gas or fluid.

The bladder 40 and raised members 18 function together to either increase or decrease the pressure exerted by the user-facing surface 16 of the support apparatus and, more specifically, the raised members 18, on the back of the user. As discussed previously, the increased pressure increases the force exerted by the raised members 18 on the dorsal spine of the user so as to cause increased stretching or lengthening of the dorsal spine. More specifically, when the size of the bladder 40 is increased, as discussed above, the user-facing surface 16 and corresponding raised members 18 are urged toward and, thus, pressed more firmly against, the user such that the pressure exerted by the user-facing surface 16 and raised members 18 on the back of the user is increased. In contrast, when the size of the bladder 40 is decreased, as discussed above, the user-facing surface 16 and corresponding raised members 18 are urged away from and, thus, pressed less firmly against, the user such that the pressure exerted by the user-facing surface 16 and raised members 18 is decreased.

Figure 3:
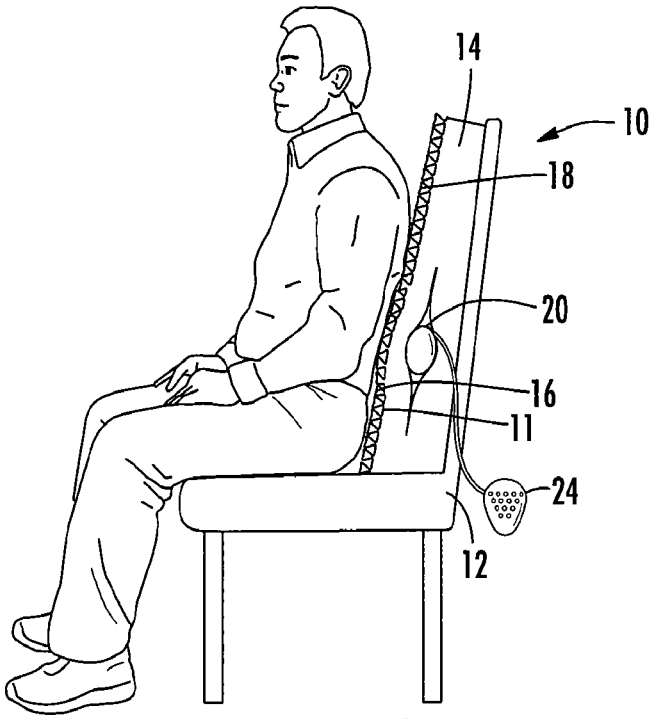
FIG. 3 is a cross-sectional view illustrating the adjustable support apparatus being used, according to one embodiment of the present invention.

In one embodiment, the support apparatus 10 is structured so that one or more bladders 40, each of which preferably has a tubular configuration, will be positioned approximate to the lumbar region of a user. For example, the bladder(s) 40 can be positioned in a back rest, mattress, mattress topper, cervical neck pillow, chair back (as illustrated in FIG. 3), etc. such that the bladder(s) will be proximate to the lumber region of the user.

Figure 5:
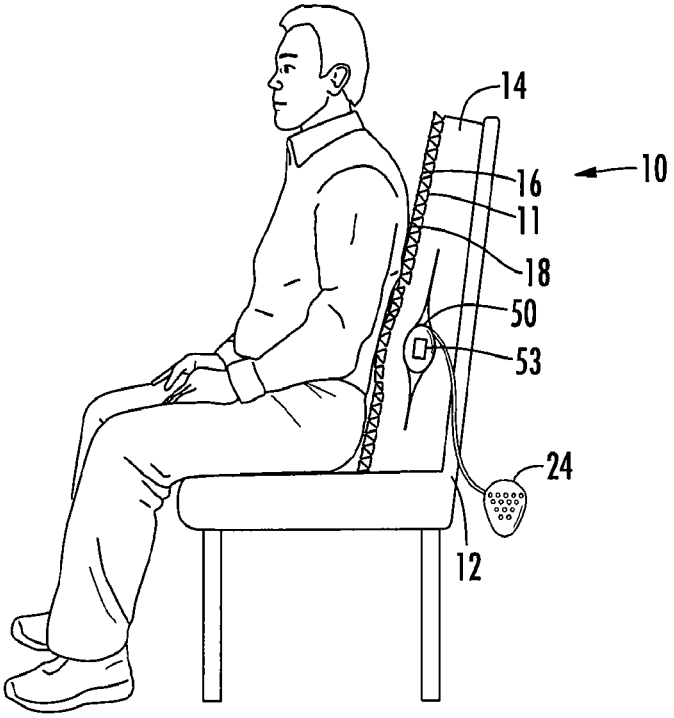
FIG. 5 is a cross-sectional view illustrating the adjustable support apparatus having a cam or cam-follower assembly as the adjustment mechanism, according to one embodiment of the present invention.

In one embodiment, as illustrated in FIG. 5, the adjustment mechanism 20 comprises a cam or cam-follower assembly 50. The cam or cam-follower assembly 50 can be formed of a variety of rigid materials, including metal, wood, hard plastic. The cam or cam-follower assembly 50 may be operated manually or using electro-mechanical control, such as controller 24 in operable communication with a servo-motor 53 or similar device. In one embodiment, the support apparatus 10 includes a plurality of cam or cam-follower assemblies 50 either positioned adjacent one another or spaced apart.

Either manually or using the controller 24, the user initiates the rotation of the assembly to urge the user-facing surface 16 and the raised members 18 toward the back of the user to increase the pressure exerted by the user-facing surface and the raised members on the user's back or, alternatively, to urge the user-facing surface and the raised members away from the back of the user to decrease the pressure exerted by the user-facing surface and the raised members on the user's back.

The cam or cam-follower assembly 50 and raised members 18 function together to either increase or decrease the pressure exerted by the user-facing surface 16 of the support apparatus and, more specifically, the raised members 18, on the back of the user. As discussed previously, the increased pressure increases the force exerted by the raised members 18 on the dorsal spine of the user so as to cause increased stretching or lengthening of the dorsal spine.

In one embodiment, the support apparatus 10 is structured so that one or more cam or cam-follower assemblies 50 will be positioned approximate to the lumbar region of a user. For example, the cam or cam-follower assemblies 50 can be positioned in a back rest, mattress, mattress topper, cervical neck pillow, chair back (as illustrated in FIG. 5), etc. such that the assemblies will be proximate to the lumber region of the user.

Figure 6:
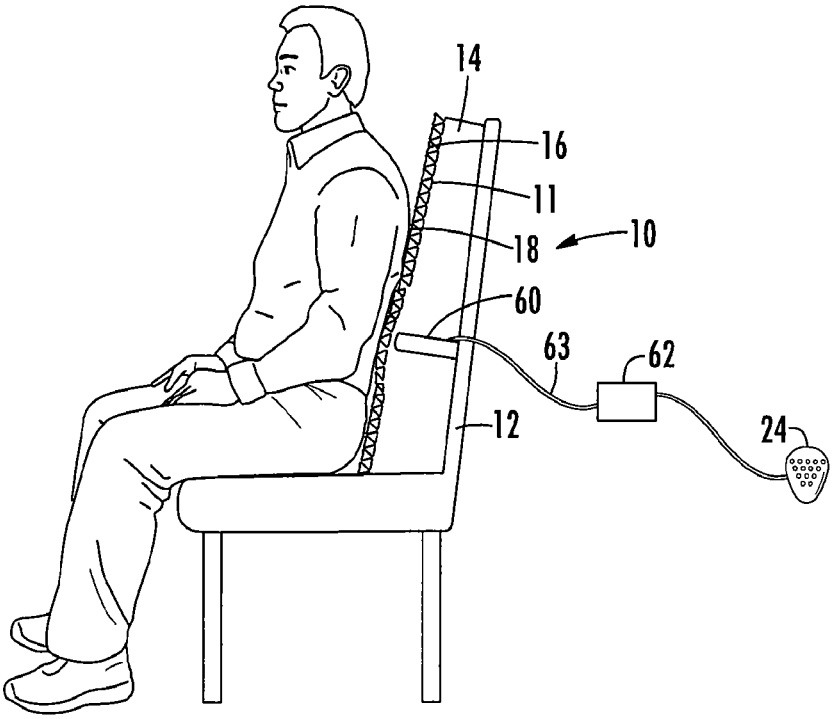
FIG. 6 is a cross-sectional view illustrating the adjustable support apparatus having a piston assembly as the adjustment mechanism, according to one embodiment of the present invention.

In one embodiment, as illustrated in FIG. 6, the adjustment mechanism 20 comprises a pneumatic or hydraulic piston assembly 60. The piston assembly 60 may be in fluid or gaseous communication with a pump 62, such as through a flexible hose 63. The piston assembly 60 can be formed of a variety of rigid materials, such as metal, wood or hard plastic. In one embodiment, the support apparatus 10 includes a plurality of piston assemblies 60 either positioned adjacent one another or spaced apart.

A controller 24 may be provided that is in operable communication with the pump 62 so that the user may initiate the pumping of gas or fluid into the piston assembly 60 to extend the piston or, alternatively, to either allow gas or fluid to leak out of the piston assembly or pump gas or fluid out of the piston assembly to retract the piston. The piston assembly 60 may include a reservoir (not shown) in gaseous or fluid communication with the pump 62 for retaining the gas or fluid used to extend the piston.

The piston assembly 60 and raised members 18 function together to either increase or decrease the pressure exerted by the user-facing surface 16 of the support apparatus and, more specifically, the raised members 18, on the back of the user. As discussed previously, the increased pressure increases the force exerted by the raised members 18 on the dorsal spine of the user so as to cause increased stretching or lengthening of the dorsal spine. More specifically, when the piston of the piston assembly 60 is extended, as discussed above, the user-facing surface 16 and corresponding raised members 18 are urged toward and, thus, pressed more firmly against, the user such that the pressure exerted by the user-facing surface 16 and raised members 18 on the back of the user is increased. In contrast, when the piston of the piston assembly 60 is retracted, as discussed above, the user-facing surface 16 and corresponding raised members 18 are urged away from and, thus, pressed less firmly against, the user such that the pressure exerted by the user-facing surface 16 and raised members 18 is decreased.

In one embodiment, the support apparatus 10 is structured so that one or more piston assemblies 60 will be positioned approximate to the lumbar region of a user. For example, the piston assemblies 60 can be positioned in a back rest, mattress, mattress topper, cervical neck pillow, chair back (as illustrated in FIG. 6), etc. such that the bladder(s) will be proximate to the lumber region of the user.

The support apparatus 10 of the present invention may also be used to apply compressive stress against other parts of the use, such as joints and other large muscle areas in order to cause stretching.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An adjustable support apparatus for a user, comprising:

a cover;

a plurality of raised members each extending from at least a portion of the cover, each raised member having a distal end, the distal ends defining a portion of a user-facing surface, wherein the spacing between adjacent raised members decreases along a length of the raised members where they extend from the cover towards the distal ends of the raised members that define the user-facing surface;

an adjustment mechanism at least partially enclosed by the cover; and wherein the adjustment mechanism is structured to be urged toward or away from the user so as to urge the user-facing surface and plurality of raised members toward or away from the user, respectively, so as to increase or decrease, respectively, the spacing between the distal ends of the raised members to thereby increase or decrease, respectively, the force exerted by the raised members against the user so as to impart a stretching or lengthening effect or contraction effect, respectively, on the vertebral column and intervertebral discs of the user.

2. A method of using an adjustable support apparatus for a user, comprising:

providing an adjustable support apparatus comprising a cover a plurality of raised members each extending from at least a portion of the cover, each raised member having a distal end, the distal ends defining a portion of a user-facing surface, and an adjustment mechanism at least partially enclosed by the cover, wherein the spacing between the adjacent raised members decreases along a length of the raised members where they extend from the cover towards the distal ends of the raised members that define the user-facing surface; and urging the user-facing surface and plurality of raised members toward the user using the adjustment mechanism so as to increase or decrease, respectively, the spacing between the distal ends of the raised members to thereby increase or decrease, respectively, the force exerted by the raised members against the user so as to impart a stretching or lengthening effect or contraction effect, respectively, on the vertebral column and intervertebral discs of the user.

3. A method as recited in claim 2, further comprising pivoting the plurality of raised members about the cover.

4. A method as recited in claim 2, wherein the adjustment mechanism comprises at least one bladder that is configured to be inflated and deflated and wherein the method comprises inflating or deflating the bladder.

5. A method as recited in claim 2, wherein the adjustment mechanism comprises at least one cam-follower assembly and wherein the method comprises rotating the cam-follower assembly.

6. A method as recited in claim 2, wherein the adjustment mechanism comprises at least one pneumatic or hydraulic piston and wherein the adjustment mechanism comprises moving the at least one piston.

7. An adjustable support apparatus as recited in claim 1, wherein the plurality of raised members protrude perpendicularly relative to the cover.

8. An adjustable support apparatus as recited in claim 1, wherein the plurality of raised members protrude at an angle relative to the cover.

9. An adjustable support apparatus as recited in claim 1, wherein the plurality of raised members are biased in a predetermined direction.

10. An adjustable support apparatus as recited in claim 1, wherein the plurality of raised members are structured to pivot about the cover.

11. An adjustable support apparatus as recited in claim 1, wherein the adjustment mechanism comprises at least one bladder that is configured to be inflated and deflated.

12. An adjustable support apparatus as recited in claim 11, wherein the adjustment mechanism comprises a pump in fluid or gaseous communication with the at least one bladder and a controller in operable communication with the pump.

13. An adjustable support apparatus as recited in claim 1, wherein the adjustment mechanism comprises at least one cam-follower assembly.

14. An adjustable support apparatus as recited in claim 1, wherein the adjustment mechanism comprises at least one pneumatic or hydraulic piston.

15. An adjustable support apparatus for a user, comprising:

a cover; a plurality of raised members each extending from at least a portion of the cover, each raised member having a distal end, the distal ends defining a portion of a user-facing surface, wherein the spacing between adjacent raised members decreases along a length of the raised members where they extend from the cover towards the distal ends of the raised members that define the user-facing surface;

an adjustment mechanism at least partially enclosed by the cover; and wherein the adjustment mechanism is structured to be urged toward or away from the user so as to urge the user-facing surface and plurality of raised members toward or away from the user, respectively, so as to increase or decrease, respectively, the spacing between the distal ends of the raised members to thereby increase or decrease, respectively, the force exerted by the raised members against the user so as to impart a stretching or lengthening effect or contraction effect, respectively, on the vertebral column and intervertebral discs of the user.

16. An adjustable support apparatus as recited in claim 15, wherein the plurality of raised members protrude perpendicularly relative to the cover.

17. An adjustable support apparatus as recited in claim 15, wherein the plurality of raised members protrude at an angle relative to the cover.

18. An adjustable support apparatus as recited in claim 15, wherein the plurality of raised members are biased in a predetermined direction.

19. An adjustable support apparatus as recited in claim 15, wherein the plurality of raised members are structured to pivot about the cover.

20. An adjustable support apparatus as recited in claim 15, wherein the adjustment mechanism comprises:

at least one bladder that is configured to be inflated and deflated;

a pump in fluid or gaseous communication with the at least one bladder; and a controller in operable communication with the pump.

* * * * *